US007439458B2

(12) United States Patent
Montalvo

(10) Patent No.: US 7,439,458 B2
(45) Date of Patent: Oct. 21, 2008

(54) FIVE-WAY DIRECTIONAL PUSH BUTTON ON A ROTARY KNOB

(75) Inventor: Juan J. Montalvo, Juarez (MX)

(73) Assignee: Delphi Technologies, Inc., Troy, MI (US)

( * ) Notice: Subject to any disclaimer, the term of this patent is extended or adjusted under 35 U.S.C. 154(b) by 11 days.

(21) Appl. No.: 11/509,858

(22) Filed: Aug. 25, 2006

(65) Prior Publication Data

US 2008/0047815 A1 Feb. 28, 2008

(51) Int. Cl.
*H01H 9/00* (2006.01)

(52) U.S. Cl. ..... 200/4; 200/5 R

(58) Field of Classification Search ..... 200/4, 200/5 R, 6 A, 17 R, 18, 517, 11 R, 11 DA, 200/14, 500, 501, 329, 336, 341; 341/20, 341/22, 35; 345/156, 157, 161, 163, 168, 345/169, 184; 338/68, 200, 198, 172
See application file for complete search history.

(56) References Cited

U.S. PATENT DOCUMENTS 4,394,546 A * 7/1983 Harumatsu ..... 200/5 R
4,857,677 A * 8/1989 Tanaka et al. ..... 200/5 R
4,878,402 A 11/1989 Behringer
5,705,778 A * 1/1998 Matsui et al. ..... 200/11 R
6,420,667 B1 * 7/2002 Miwa et al. ..... 200/4
6,555,770 B2 * 4/2003 Kawase ..... 200/18
6,621,016 B2 * 9/2003 Ohba et al. ..... 200/4
6,694,236 B2 * 2/2004 Onodera ..... 701/36
6,953,900 B2 * 10/2005 Sottong ..... 200/5 R
7,091,430 B1 * 8/2006 Haizima et al. ..... 200/6 A

FOREIGN PATENT DOCUMENTS

| | | |
|---|---|---|
| DE | 19853587 | 5/2000 |
| EP | 1315188 | 5/2003 |
| FR | 2867305 | 9/2005 |

* cited by examiner

*Primary Examiner*—Michael A Friedhofer
(74) *Attorney, Agent, or Firm*—Jimmy L. Funke

(57) ABSTRACT

A rotary knob and push button assembly comprising a rotary knob being configured to rotate, a rotary actuated potentiometer actuated by rotation of the rotary knob, and at least four actuators within the rotary knob. Each actuator is configured to selectively activate a selected circuit. The actuators do not rotate with rotation of the rotary knob.

15 Claims, 6 Drawing Sheets

FIVE-WAY DIRECTIONAL PUSH BUTTON ON A ROTARY KNOB

TECHNICAL FIELD

The present invention concerns control assemblies, and more particularly relates to control assemblies having a rotary knob.

BACKGROUND OF THE INVENTION

Control assemblies using buttons and knobs can be used in a wide variety of applications. For example, buttons can be used in vehicles to control a radio, air conditioning or many other features. Furthermore, the control assemblies can typically be used in any application that has switches actuated by buttons or knobs.

An improved control assembly is desired.

SUMMARY OF THE INVENTION

An aspect of the present invention is to provide a rotary knob and push button assembly comprising a rotary knob being configured to rotate, a rotary actuated potentiometer actuated by rotation of the rotary knob, and at least four actuators within the rotary knob. Each actuator is configured to selectively activate a selected circuit. The actuators do not rotate with rotation of the rotary knob.

Another aspect of the present invention is to provide a method of controlling an electronic component comprising providing a rotary knob being configured to rotate, actuating a rotary actuated potentiometer by rotation of the rotary knob, providing at least four actuators within the rotary knob, and selectively actuating at least one of the actuators to selectively activate a selected circuit. The actuators do not rotate with rotation of the rotary knob.

These and other aspects, objects, and features of the present invention will be understood and appreciated by those skilled in the art upon studying the following specification, claims, and appended drawings.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
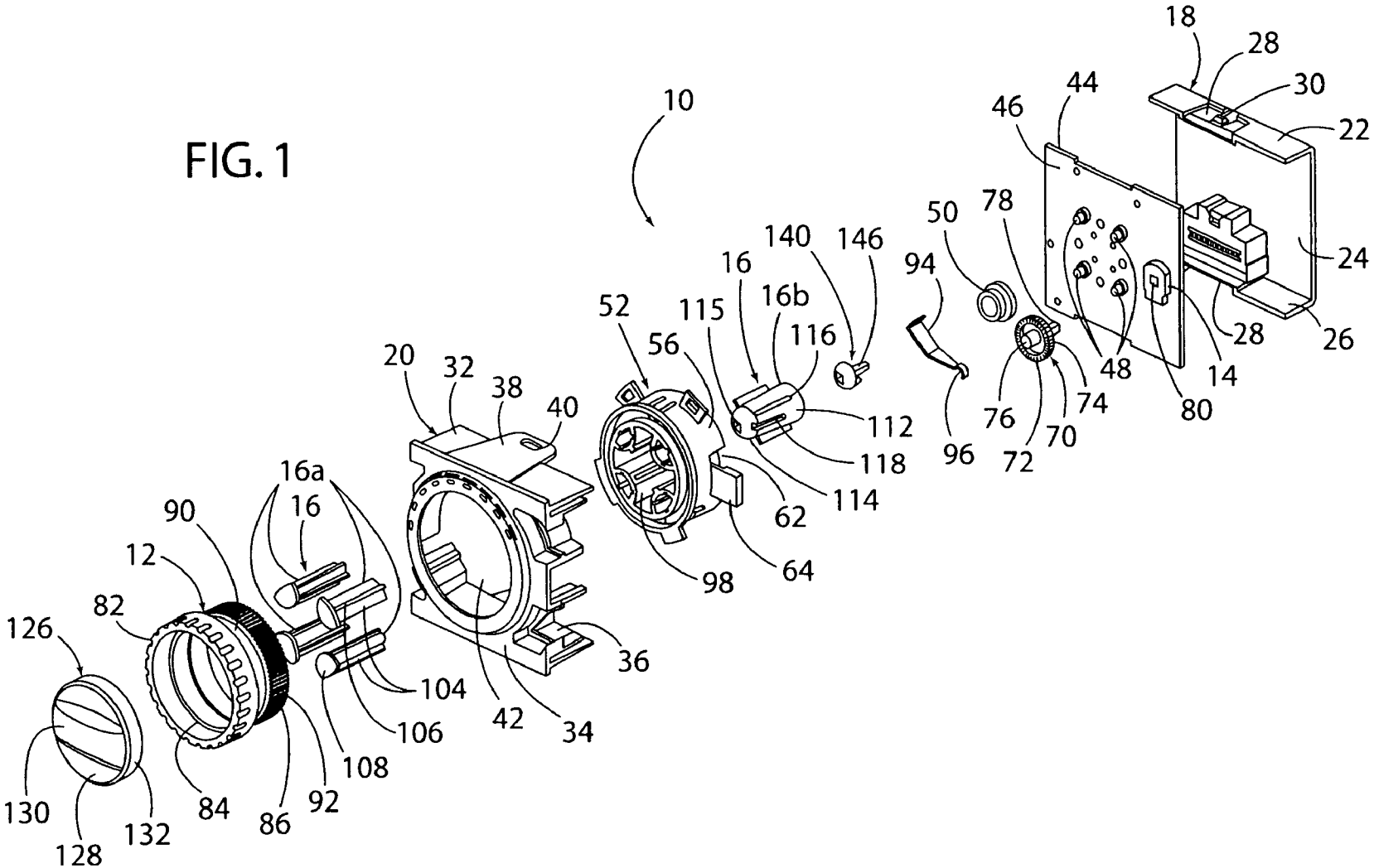
FIG. 1 is an isometric exploded view of a knob assembly of the present invention.

For purposes of description herein, orientation terms shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference number 10 (FIGS. 1, 1A and 8) generally designates a rotary knob and push button assembly embodying the present invention. In the illustrated example, the rotary knob and push button assembly 10 comprises a rotary knob 12 being configured to rotate, a rotary actuated potentiometer 14 actuated by rotation of the rotary knob 12, and at least four actuators 16 within the rotary knob 12, each actuator 16 being configured to selectively activate a selected circuit. The actuators 16 do not rotate with rotation of the rotary knob 12.

The illustrated rotary knob and push button assembly 10 is preferably used in a vehicle to control at least one of the electronic components of the vehicle. For example, the rotary knob and push button assembly 10 can be used to control an audio system, a heating, ventilating and air-conditioning system (HVAC), a navigation system, an infotainment system or any other system. The rotary knob and push button assembly 10 is preferably placed in a housing (possibly having a front module portion and a rear module portion with the rotary knob and push button assembly 10 therein). However, the housing of the rotary knob and push button assembly 10 could include only one module portion or any part of the vehicle (or other location of the rotary knob and push button assembly 10) itself. The module is preferably configured to be installed into a corresponding slot for receiving the module in an instrument panel of the vehicle.

The illustrated rotary knob and push button assembly 10 comprises the housing having a rear case 18 and a faceplate 20. The rear case 18 and the faceplate 20 comprise the module configured to be inserted into a vehicle. The rear case 18 includes a top wall 22, a rear wall 24 and a bottom wall 26. Each of the top wall 22 and the bottom wall 26 includes a recessed area 28 in a top and bottom thereof, respectively. The recessed area 28 each include a projection 30. The faceplate 20 includes top wall 32, a facing wall 34 and a bottom wall 36. The top wall 32 and the bottom wall 36 each include a rearwardly projecting flap 38 with an opening 40 therethrough. The faceplate 20 is connected to the rear case 18 by positioning the flaps 38 into the recessed areas 28 of the rear case 18 and inserting the projections 30 into the openings 40 in the flaps 38. The facing wall 34 includes a circular opening 42 having the rotary knob 12 extending therethrough. However, it is contemplated that any housing could be used.

In the illustrated embodiment, the rotary knob and push button assembly 10 includes a circuit board 44 located within the housing and including circuits printed thereon for controlling the audio system, the heating, ventilating and air-conditioning system (HVAC), the navigation system, the infotainment system or any other system. The circuit board 44 can be single or double sided. The rotary actuated potentiometer 14 is preferably surface mounted to a front 46 of the circuit board 44. As is well known to those skilled in the art, the rotary actuated potentiometer 14 is used to change the resistance of a circuit to thereby alter the output of the circuit (e.g., raise or lower volume of an audio system, raise or lower the temperature of an HVAC system, etc.). In the illustrated embodiment, the circuit board 44 includes four contact switches 48 and a centrally located switch pad 50. Each of the four contact switches 48 and the switch pad 50 comprise a flexible dome. The circuit board 44 preferably includes at least one contact (not shown) on a surface thereof for engaging with the flexible domes positioned adjacent the front 46 of the circuit board 44. The flexible domes can be depressed to allow a contact of the flexible dome to contact at least one corresponding contact on the circuit board 44 as is well known to those skilled in the art to close a circuit on the circuit board 44. The rotary knob 12 is configured to transfer rotary force to the rotary actuated potentiometer 14 to adjust the rotary actuated potentiometer 14 to a desired resistance.

Figure 1A:
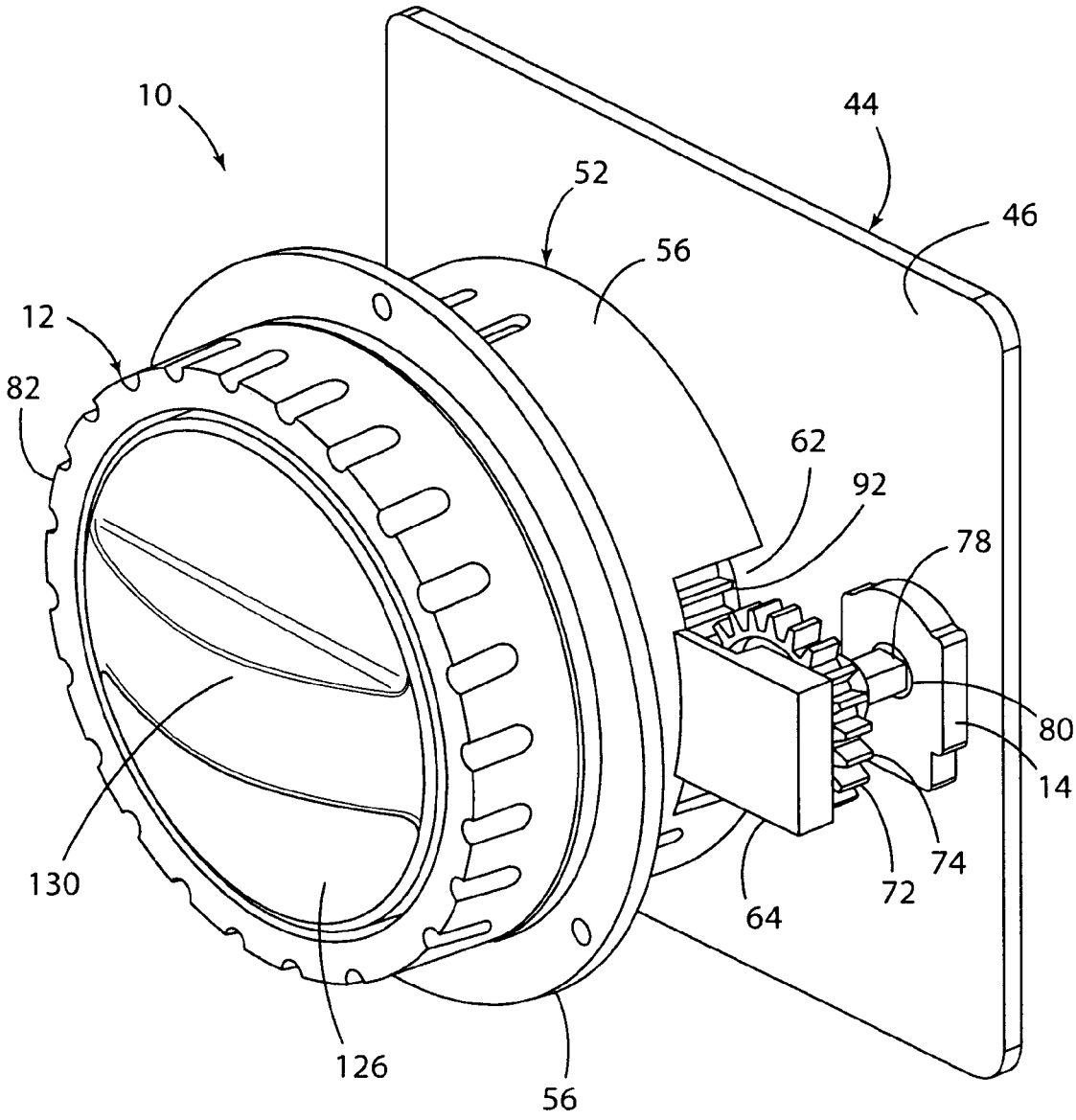
FIG. 1A is an isometric view of the knob assembly of the present invention.

The illustrated rotary knob and push button assembly 10 includes a knob shell 52 that is fixed in position within the housing relative to the circuit board 44 and that accepts the rotary knob 14 therein. The knob shell 52 is preferably made of plastic, although other materials are contemplated (e.g., metal). The knob shell 52 includes an inner cylinder 54, an outer cylinder 56, an annular ring plate 58 connecting a rear of the inner cylinder 54 to a rear of the outer cylinder 56, and an interrupted flange 60 extending from a periphery of the outer cylinder 56. As illustrated in FIGS. 1 and 1A, the knob shell 52 includes a gear slot 62 in the outer cylinder 56 and a portion of the annular ring plate 58. The outer cylinder 56 further includes a pin housing 64 extending outwardly therefrom adjacent the gear slot 62, with the pin housing 64 including a tubular gear receiver 65. The knob shell 52 is configured to accept the rotary knob 12 between the inner cylinder 54 and the outer cylinder 56. It is contemplated that the knob shell 52 could be fixed to the housing or be part of the housing described above through openings 66 in the interrupted flange 60. The inner cylinder 54 also includes actuator housings 68 for accepting the actuators 16 as discussed in more detain below.

In the illustrated example, a transfer gear 70 is connected to the knob shell 52 and the rotary actuated potentiometer 14 and is configured to actuate the rotary actuated potentiometer 14. The transfer gear 70 includes a center gear wheel 72 having teeth 74, a front pin 76 extending forwardly from the center gear wheel 72 and a rear pin 78 extending rearwardly from the center gear wheel 72. The rear pin 78 is configured to extend into a corresponding opening 80 in the rotary actuated potentiometer 14 to actuate the rotary actuated potentiometer 14 as is well known to those skilled in the art. Preferably, the rear pin 78 is non-circular. The front pin 76 is circular and extends into the tubular gear receiver 65 in a rear of the pin housing 64 extending from the outer cylinder 56 of the knob shell 52. Therefore, the rotary actuated potentiometer 14 and the pin housing 64 extending from the outer cylinder 56 of the knob shell 52 maintain the transfer gear 70 in position, but allow the transfer gear 70 to rotate. The transfer gear 70 transmits rotary force from the rotary knob 12 to the rotary actuated potentiometer 14.

Figure 7:
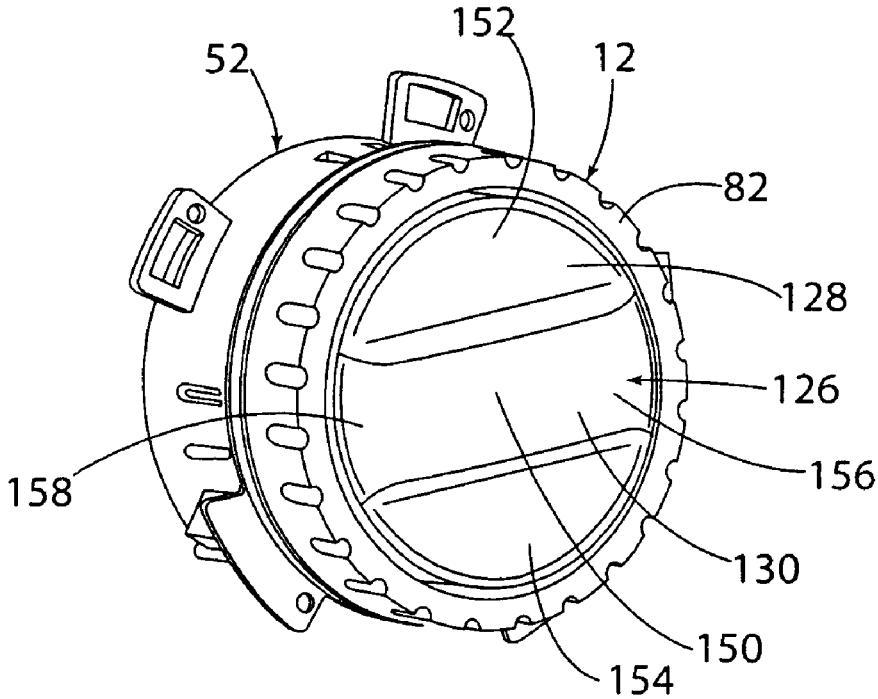
FIG. 7 is an isometric view of the button, the knob shell and a rotary knob of the knob assembly of the present invention.
Figure 8:
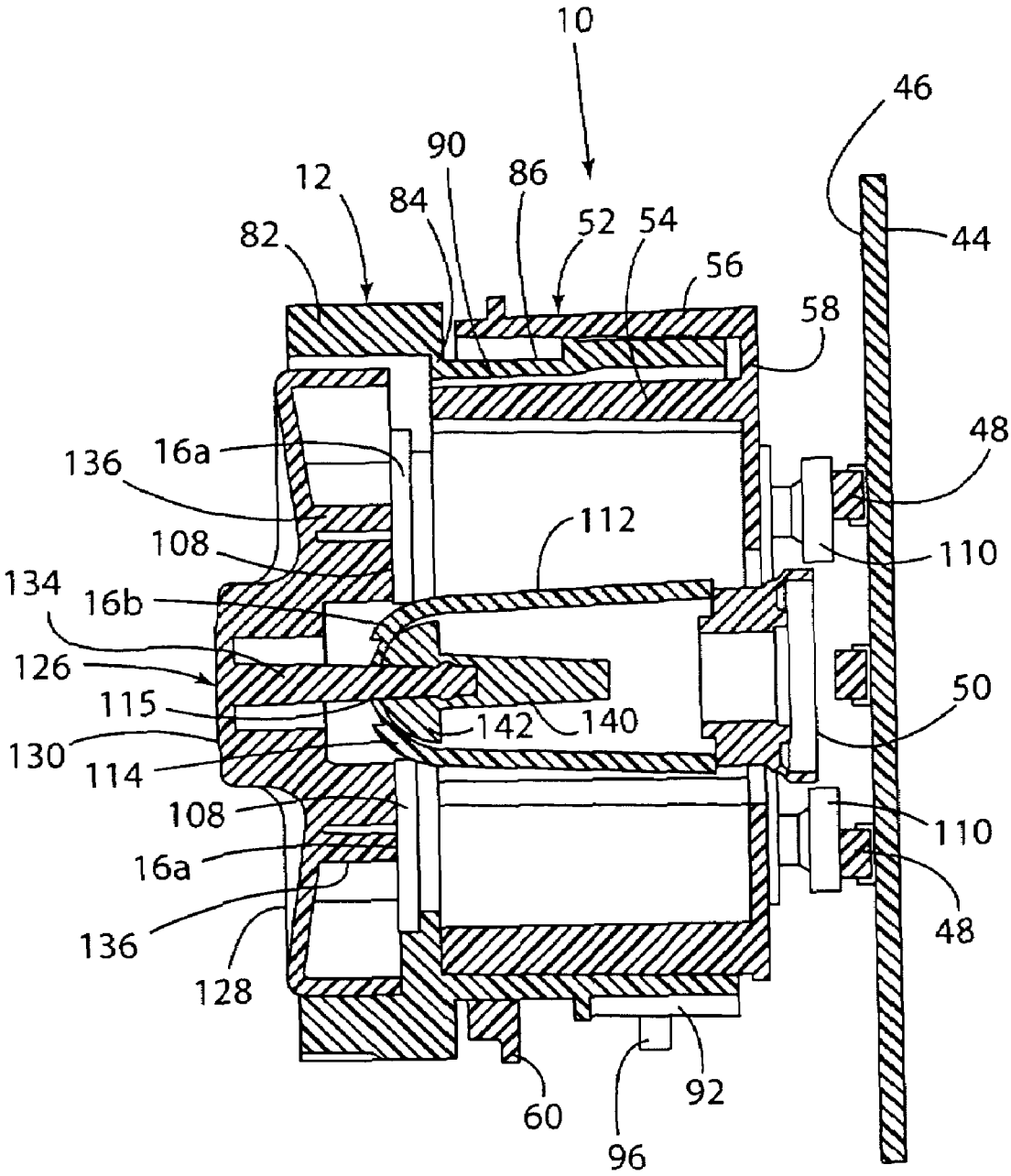
FIG. 8 is a cross-sectional view of the knob assembly of the present invention.

The illustrated rotary knob 12 can be rotated to transfer rotary force to the rotary actuated potentiometer 14 via the transfer gear 70. The rotary knob 12 is preferably made of plastic, although other materials are contemplated (e.g., metal). The rotary knob 12 includes a front tube portion 82, a transition portion 84 and a rear tube portion 86. As illustrated in FIGS. 7 and 8, the rear tube portion 86 of the rotary knob 12 is inserted between the inner cylinder 54 and the outer cylinder 56 of the knob shell 52, with the front tube portion 82 being located in front of the outer cylinder 56 of the knob shell 52. Furthermore, an inner surface of the outer cylinder 56 of the knob shell 52 includes at least one projection 88 configured to be inserted into a circular slot 90 on an outer surface of the rear tube portion 86 of the rotary knob 12. Therefore, the rotary knob 12 is connected to the knob shell 52 by inserting the rear tube portion 86 between the inner cylinder 54 and the outer cylinder 56 of the knob shell 52. As the rear tube portion 86 abuts at least one projection 88, a ramped front surface of the at least one projection 88 abuts against the end of the rear tube portion 86 and bends outward until the at least one projection 88 can fit within the circular slot 90. Therefore, the rotary knob 12 can rotate within the knob shell 52. The rear tube portion 86 includes knob teeth 92 on an end thereof. The knob teeth 92 engage the teeth 74 of the center gear wheel 72 of the transfer gear 70 through the gear slot 62 in the knob shell 52.

Therefore, according to the rotary knob and push button assembly 10 of the present invention, rotation of the rotary knob 12 transmits rotary force to the rotary actuated potentiometer 14. Rotation of the rotary knob 12 causes the knob teeth 92 thereon to rotate. The knob teeth 92 will thereafter transfer rotary motion to the teeth 74 of the transfer gear 70 through the gear slot 62 in the knob shell 52, thereby causing the transfer gear 70 to rotate. Rotation of the transfer gear 70 will cause rotation of the rear pin 78 of the transfer gear 70 to rotate, thereby adjusting the rotary actuated potentiometer 14 to a desired resistance. Preferably, rotation of the rotary knob 12 transmits rotary force to the rotary actuated potentiometer 14 via the transfer gear 70 on a 1:1 rotational basis. However, other rotational bases are contemplated. Furthermore, as illustrated in FIG. 1A, a leaf spring 94 includes a curved end 96 that is biased against the knob teeth 92 of the rotary knob 12. The curved end 96 extends into spaces between the knob teeth 92 as the rotary knob 12 is rotated thereby providing a detent feel to the rotary knob 12. Accordingly, the person rotating the rotary knob 12 will know when the rotary knob 12 is rotated to a particular position (e.g., between three settings: fan low, fan medium, and fan high). It is contemplated that other methods of providing a detent feel could be used.

Figure 6:
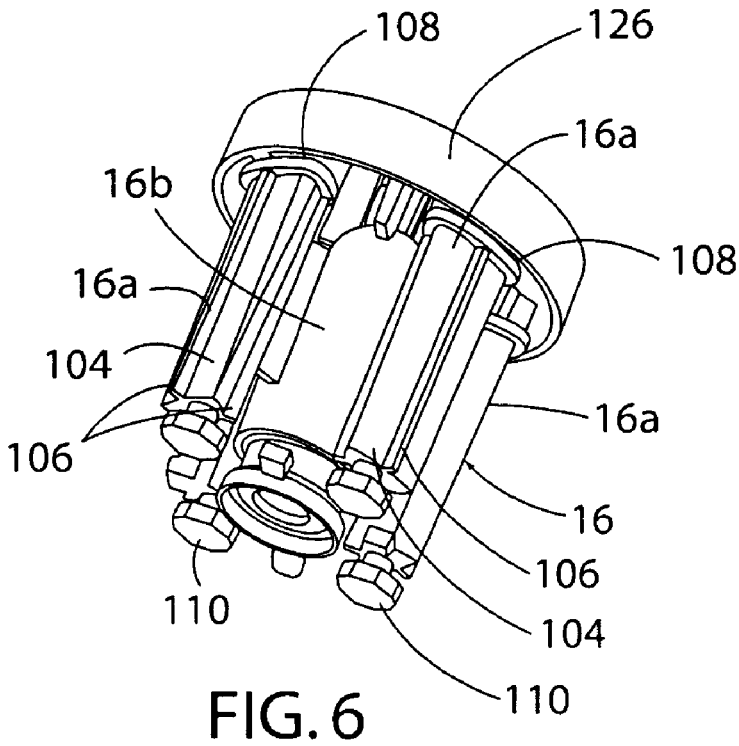
FIG. 6 is an isometric view of the button, the elbow actuator and actuators of the knob assembly of the present invention.

In the illustrated example, the rotary knob and push button assembly 10 includes at least four actuators 16 within the rotary knob 12, with each actuator 16 being configured to selectively activate a selected circuit. As illustrated in FIGS. 1 and 6, one embodiment of the present invention include at least four actuators 16 that comprise four outside actuators 16*a* and a centrally located actuator 16*b*. The four outside actuators 16*a* slide within the actuator housings 68 of the inner cylinder 54 of the knob shell 52. The actuator housings 68 each comprise a C-shaped wall 98 extending from the inner cylinder 54 of the knob shell 52 and defining a triangular shaped opening 100 therein. The triangular shaped opening 100 includes a plurality of slots 102. The outside actuators 16*a* each comprise a wedge shaped middle 104, three alignment flanges 106 extending from the wedge shaped middle 104, an actuator head 108 at a first end of the wedge shaped middle 104 and a post 110 extending from a second end of the wedge shaped middle 104. The outside actuators 16*a* are configured to slide within the triangular shaped openings 100 of the actuator housings 68, with the alignment flanges 106 of the outside actuator 16*a* sliding within the slots 102 of the triangular shaped opening 100. Each post 110 is aligned with one of the four contact switches 48 on the circuit board 44. When the actuator head 108 of one of the outside actuators 16*a* is depressed, the outside actuator 16*a* will slide within the triangular shaped opening 100 and the post 110 will depress one of the four contact switches 48 to activate or deactivate a circuit on the circuit board 44. It is contemplated that the actuators 16*a* and their associated openings 100 in the actuator housings 68 could have any cross-sectional shape.

Figure 3:
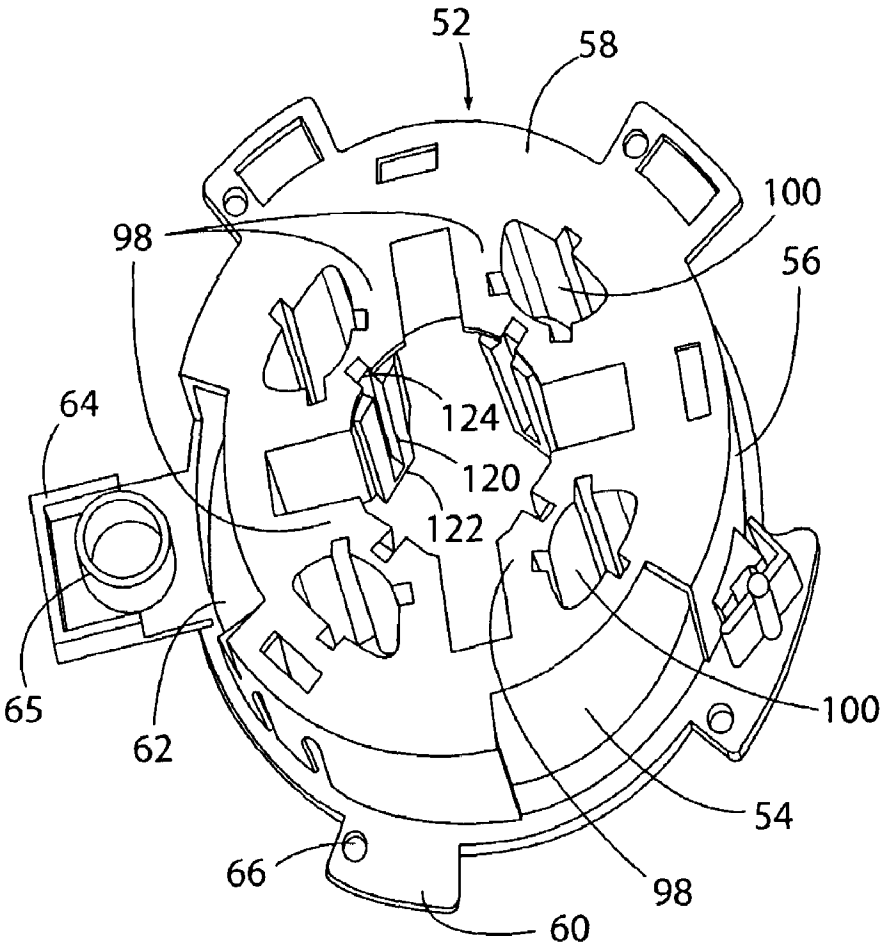
FIG. 3 is a front isometric view of a knob shell of the knob assembly of the present invention.
Figure 2:
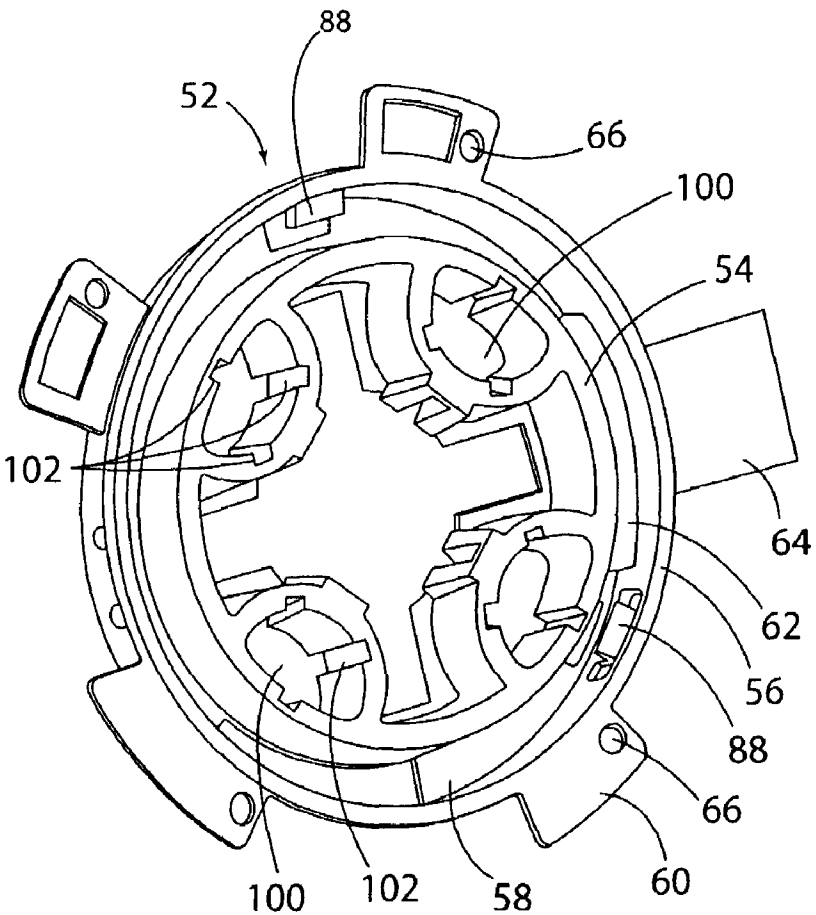
FIG. 2 is a rear isometric view of a knob shell of the knob assembly of the present invention.
Figure 5:
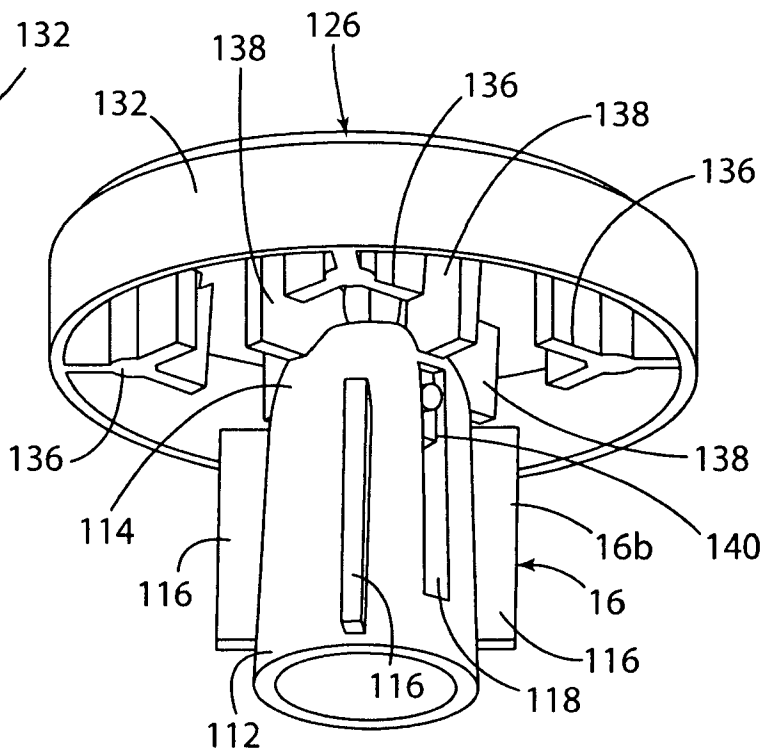
FIG. 5 is an isometric view of the button, the elbow actuator and an actuator of the knob assembly of the present invention.
Figure 4:
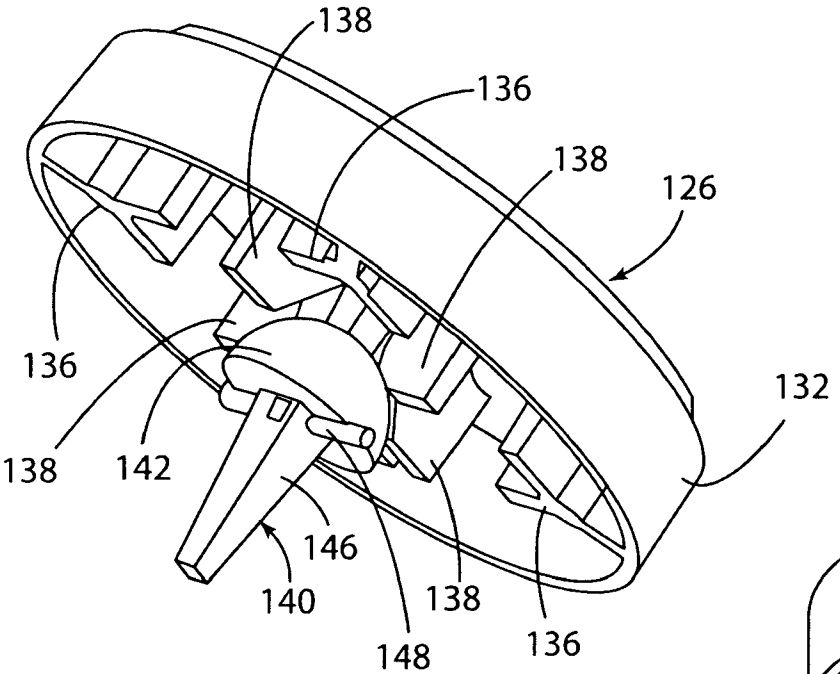
FIG. 4 is an isometric view of a button and an elbow actuator of the knob assembly of the present invention.

The illustrated centrally located actuator 16*b* is located inside of the outside actuators 16*a* and is configured to actuate the switch pad 50 on the circuit board 44. The centrally located actuator 16*b* includes a tubular body 112, a dome shaped cap 114 having a central opening 115, four aligned fins 116 extending from the tubular body 112 and a pair of opposing slots 118. The centrally located actuator 16*b* is configured to slide within the knob shell 52. As illustrated in FIGS. 2 and 3, each C-shaped wall 98 of the actuator housings 68 includes a channel 120 on an outside thereof having a closed end 122 and an open end 124. The fins 116 of the centrally located actuator 16*b* are slid into the channels 120 on the actuator housings 68 with the dome shaped cap 114 facing the closed end of the channels 120 such that the centrally located actuator 16*b* is configured to slide within the knob shell 52. When the dome shaped cap 114 of the knob shell 52 is depressed, a rear end of the tubular body 112 of the centrally located actuator 16*b* will abut against the switch pad 50 on the circuit board 44 to activate or deactivate a circuit on the circuit board 44.

In the illustrated example, a button 126 is depressed to selectively push one of the actuators 16 into engagement with one of the contact switches 48 or the switch pad 50 to activate or deactivate a circuit on the circuit board 44. The button 126 includes an annular front face 128 with a ridge 130, a circular flange 132 extending from a periphery of the front face 128 and a centrally located post 134 extending from an underside of the front face 128. The underside of the front face 128 also includes a plurality of outside actuating projections 136 for depressing the outside actuators 16*a* and a plurality of inside flanges 138 having a bottom surface defining a hemisphere for accepting the centrally located actuator 16*b* therein. The button 126 is connected to the dome shaped cap 114 of the centrally located actuator 16*b* therein.

In the illustrated embodiment, an elbow actuator 140 assists in connecting the button 126 to the centrally located actuator 16*b*. The elbow actuator 140 includes a semi-spherical dome 142 having a central opening 144, a rearwardly extending column 146 and a pin 148. The elbow actuator 140 is inserted into the tubular body 112 of the centrally located actuator 16*b* until the semi-spherical dome 142 abuts against an inside of the dome shaped cap 114. Furthermore, the central opening 144 in the semi-spherical dome 142 of the elbow actuator 140 is aligned with the central opening 115 in the dome shaped cap 114 of the centrally located actuator 16. Furthermore, each end of the pin 148 extends into the pair of opposing slots 118 of the tubular body 112 of the centrally located actuator 16*b* to connect the elbow actuator 140 to the centrally located actuator 16*b*.

As illustrated in FIG. 8, the centrally located post 134 of the button 126 extends through the central opening 115 in the dome shaped cap 114 of the centrally located actuator 16 and into the central opening 144 in the semi-spherical dome 142 of the elbow actuator 140 to connect the button 126 to the elbow actuator 140. The elbow actuator 140 allows the button 126 to rotate about a first pivot axis defined along the axis of the pin 148 of the elbow actuator 140 (wherein the pin 148 remains stationary) and a second pivot axis defined perpendicular to the axis of the pin 148 (wherein one end of the pin 148 slides within the slot 118 of the tubular body 112 of the centrally located actuator 16*b*). Furthermore, the button 126 can be centrally depressed whereby each end of the pin 148 slides within the slot 118 of the tubular body 112 of the centrally located actuator 16*b*.

The illustrated button 126 defines five depression points on the front face 128 thereof: a center depression point 150, a first outside depression point 152, a second outside depression point 154, a third outside depression point 156 and a fourth outside depression point 158 (see FIG. 7). The first outside depression point 152 and the third outside depression point 156 are on opposite sides of the center depression point 150 and the second outside depression point 154 and the fourth outside depression point 158 are on opposite sides of the center depression point 150, with the first outside depression point 152, the second outside depression point 154, the third outside depression point 156 and the fourth outside depression point 158 defining four corners of a square. Furthermore, the first outside depression point 152, the second outside depression point 154, the third outside depression point 156 and the fourth outside depression point 158 each include one of the plurality of outside actuating projections 136 located underneath on the opposite side of the annular front face 128 of the button 126.

The button 126 is depressed to move at least one of the actuators 16 into engagement with one of the contact switches 48 or the switch pad 50 to activate or deactivate a circuit on the circuit board 44. When the center depression point 150 is depressed, the plurality of inside flanges 138 on the underside of the front face 128 of the button 126 will push against the dome shaped cap 114 of the centrally located actuator 16*b* to move the tubular body 112 against the centrally located switch pad 50 (to the left in FIG. 8), thereby activating or deactivating the circuit associated with the centrally located switch pad 50. When any one of the first outside depression point 152, the second outside depression point 154, the third outside depression point 156 or the fourth outside depression point 158 is depressed, the outside actuating projection 136 on the underside of the front face 128 of the button 126 located behind the corresponding depression point will push against the one the outside actuators 16*a*. Therefore, the outside actuator 16*a* will slide through the triangular shaped opening 100 in the knob shell 52 and into engagement with the associated (to the left in FIG. 8), thereby activating or deactivating the circuit associated with the contact switches 48.

It will be understood by those who practice the invention and those skilled in the art, that various modifications and improvements may be made to the invention without departing from the spirit of the disclosed concept. For example, the rotary actuated potentiometer 14 could be a ring potentiometer that surrounds the rotary knob 12 and that is actuated directly by rotation of the rotary knob 12. The scope of protection afforded is to be determined by the claims and by the breadth of interpretation allowed by law.

The invention claimed is:

1. A knob and push button assembly comprising:

a rotary knob being configured to rotate;

a rotary actuated potentiometer actuated by rotation of the rotary knob;

at least four actuators within the rotary knob, each of the actuators being configured to selectively activate a selected circuit;

wherein the actuators do not rotate with rotation of the rotary knob;

a knob shell having the rotary knob therein, the knob shell not rotating with rotation of the rotary shell; and a button configured to selectively actuate all of the at least four actuators.

2. The knob and push button assembly of claim 1, further including: a circuit board having the rotary actuated potentiometer connected thereto.

3. The knob and push button assembly of claim 2, further including:

a plurality of flexible domes, each of the flexible domes associated with one of the actuators and configured to be engaged by the actuators to selectively activate the selected circuit.

4. The knob and push button assembly of claim 1, further including:

a transfer gear transferring the rotary motion of the rotary knob to the rotary actuated potentiometer, the transfer gear being engaged with an outside peripheral surface of the rotary knob.

5. The knob and push button assembly of claim 1, wherein: the actuators engage and slide within the knob shell.

6. The knob and push button assembly of claim 1, wherein:

the at least four actuators comprise five actuators, with one of the actuators being located in a center of an area defined by the other actuators.

7. The knob and push button assembly of claim 1, wherein: each of the actuators can be individually actuated without actuating the other actuators.

8. A knob and push button assembly comprising:

a rotary knob being configured to rotate;

a rotary actuated potentiometer actuated by rotation of the rotary knob;

at least four actuators within the rotary knob, each of the actuators being configured to selectively activate a selected circuit;

wherein the actuators do not rotate with rotation of the rotary knob;

wherein each of the actuators can be individually actuated without actuating the other actuators; and a button configured to selectively actuate all of the at least four actuators.

9. A method of controlling an electronic component comprising:

providing a rotary knob being configured to rotate;

actuating a rotary actuated potentiometer by rotation of the rotary knob;

providing at least four actuators within the rotary knob; and selectively actuating at least one of the actuators to selectively activate a selected circuit;

wherein the actuators do not rotate with rotation of the rotary knob;

including a knob shell having the rotary knob therein, the knob shell not rotating with rotation of the rotary shell; and depressing a button to selectively actuate one of the at least four actuators.

10. The method of controlling an electronic component of claim 9, further including:

connecting the rotary actuated potentiometer to a circuit board.

11. The method of controlling an electronic component of claim 10, further including:

associating each of the actuators with a flexible dome; and engaging one of the flexible domes with one of the actuators to selectively activate the selected circuit.

12. The method of controlling an electronic component of claim 9, further including:

transferring rotary motion of the rotary knob to the rotary actuated potentiometer with a transfer gear, the transfer gear being engaged with an outside peripheral surface of the rotary knob.

13. The method of controlling an electronic component of claim 9, further including:

sliding and engaging the actuators within the knob shell.

14. The method of controlling an electronic component of claim 9, wherein:

the at least four actuator comprise five actuators, with one of the actuators being located in a center of an area defined by the other actuators.

15. The method of controlling an electronic component of claim 9, wherein:

each of the actuators can be individually actuated without actuating the other actuators.

* * * * *